US006813469B2

(12) United States Patent
Park

(10) Patent No.: US 6,813,469 B2
(45) Date of Patent: Nov. 2, 2004

(54) TONER CARTRIDGE ASSEMBLY AND PRINTING APPARATUS

(75) Inventor: Dong-hoon Park, Bucheon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 40 days.

(21) Appl. No.: 10/316,855

(22) Filed: Dec. 12, 2002

(65) Prior Publication Data

US 2003/0161658 A1 Aug. 28, 2003

(30) Foreign Application Priority Data

Feb. 27, 2002 (KR) ..... 2002-10497

(51) Int. Cl.[7] ..... G03G 21/12; G03G 21/18

(52) U.S. Cl. ..... 399/360; 399/113; 399/119; 399/120

(58) Field of Search ..... 399/120, 358, 399/360, 119, 113, 126

(56) References Cited

U.S. PATENT DOCUMENTS 4,432,632 A * 2/1984 Yokota ..... 399/113
5,089,849 A * 2/1992 Hiraoka ..... 399/119
5,289,241 A * 2/1994 Sugiyama et al. ..... 399/120
5,309,211 A * 5/1994 Yoshioka ..... 399/113
5,369,475 A * 11/1994 Kashiwagi ..... 399/119
5,369,479 A * 11/1994 Tsuyuki ..... 399/113
6,542,706 B2 * 4/2003 Toba et al. ..... 399/113
6,636,712 B2 * 10/2003 Shimaoka ..... 399/113
6,741,822 B2 * 5/2004 Ishiguro et al. ..... 399/119

FOREIGN PATENT DOCUMENTS

JP 05232752 A * 9/1993 ..... G03G/15/00
JP 2001265114 A * 9/2001 ..... G03G/15/08

* cited by examiner

*Primary Examiner*—Susan Lee
(74) *Attorney, Agent, or Firm*—Staas & Halsey LLP

(57) ABSTRACT

A toner cartridge assembly corresponding to a photosensitive drum cartridge disposed at a printing apparatus body. The toner cartridge assembly develops toner on the photosensitive drum and collects used toner and includes a toner cartridge corresponding to the photosensitive drum cartridge at the body, the toner cartridge having a developing roller to develop the stored toner on the photosensitive drum; and a used toner chamber movably connected with one side of the toner cartridge to store used toner collected from the photosensitive drum cartridge. The used toner chamber is fixed at a predetermined position on the printing apparatus body, and the toner cartridge adjusts a developing nip between the photosensitive drum and the developing roller by being connected with the used toner chamber in a way that the toner cartridge can reciprocate and rotate in a direction of the photosensitive drum.

20 Claims, 5 Drawing Sheets

TONER CARTRIDGE ASSEMBLY AND PRINTING APPARATUS

CROSS-REFERENCE TO RELATED APPLICATIONS

This application claims the benefit of Korean Application No. 2002-10497, filed Feb. 27, 2002, in the Korean Industrial Property Office, the disclosure of which is incorporated herein by reference.

BACKGROUND OF THE INVENTION

1. Field of the Invention

The present invention relates to a toner cartridge assembly and a printing apparatus.

2. Description of the Related Art

A conventional printing apparatus using an electrophotographic method such as a laser printer, a photocopying machine, or a facsimile machine develops a desired image by developing an electrostatic latent image with a developing agent, after forming the electrostatic latent image by projecting a laser beam on a photosensitive medium such as a photosensitive drum. The image developed on the photosensitive medium is transferred to a printing paper passing through to a transfer nip between the photosensitive medium and a transfer roller, and is settled on the printing paper at a settlement unit.

The printing apparatus has a developing cartridge to form the image. Referring to FIG. 1, the conventional developing cartridge has a developing unit and a toner supplying unit including a cartridge body 10. The cartridge body 10 has a charging roller 12, a developing roller 13, and a cleaning blade 14, all surrounding a photosensitive drum 11.

Moreover, inside of the cartridge body 10, there is a used toner chamber 10*a* at one side of the photosensitive drum 11 and a new toner chamber 10*b* at another side of the photosensitive drum 11.

According to the above structure, the photosensitive drum 11 is charged by the transfer roller 12, and an electrostatic latent image is formed on one side thereof by a light charging roller 12, and an electrostatic latent image is formed on one side thereof by a light projected from a laser projection unit (not shown). In addition, a visible image is formed at the electrostatic latent image area as toner supplied from the new toner chamber 10*b* is transferred by the developing roller 13. The formed visible image is copied to the paper P passing through between the photosensitive drum 11 and a developing roller 20.

In the meantime, in the developing cartridge having the above structure, the elements inside of the cartridge body 10 are manufactured together, and when the toner is used up, the entire cartridge is exchanged. Therefore, the elements cannot be individually exchanged. Accordingly, a contact status (hereinbelow, referred to as a developing nip) between the photosensitive drum 11 and the developing roller 13 is compulsorily regulated.

However, according to the above structure, as the photosensitive drum 11 and the developing roller 13 are installed to be fixed at the cartridge body 10, the developing nip between the photosensitive drum 11 and the developing roller 13 is irregular, thus there are problems caused by the developing nip.

The irregular developing nip is caused by run out of the elements of the photosensitive drum 11 and the developing roller 13. In other words, the run out of the photosensitive drum 11 cannot be reduced within 0.05 mm, and the run out of the developing roller 13 reaches up to 0.1 mm. When two elements are united, the developing nip in a lengthwise direction of the photosensitive drum 11 is 0–0.15 mm.

When the developing nip in the developing cartridge of a contact developing method is zero, the toner on the developing roller 13 can be theoretically developed on the photosensitive drum 11. Yet, in practice, the toner can be developed when the overlapping volume of a distance between axes of the developing roller 13 and the photosensitive drum 11 is at least 0.05 mm.

Therefore, the developing nip is within the range of 0.05 mm to 0.2 mm as the overlapping volume of the distance between the axes, the developing roller 13 and the photosensitive drum 11 have a contact area having 0.05 mm of the overlapping volume and another contact area having 0.2 mm of the overlapping volume. Furthermore, there is a large difference in the mechanical power that the toner receives at a contact area having different overlapping volumes from each other.

If the developing nip is irregular in the lengthwise direction of the photosensitive drum 11, the toner cannot stably settle on the photosensitive drum 11 when the toner is transferred from the developing roller 13 to the photosensitive drum 11, and the toner is removed or recollected to the developing roller 13. Therefore, there is a problem in the image, specifically, the density of the image is not uniform, or the image is distorted.

SUMMARY OF THE INVENTION

Accordingly, it is an object of the present invention to overcome the above-mentioned problems of the prior art.

It is another object of the present invention to provide a toner cartridge assembly and a printing apparatus having an improved structure to maintain the developing nip as the toner cartridge assembly is settled by being separated from a photosensitive drum cartridge.

Additional objects and advantages of the invention will be set forth in part in the description which follows and, in part, will be obvious from the description, or may be learned by practice of the invention.

The foregoing and other objects of the present invention are achieved by providing a toner cartridge assembly installed to correspond to a photosensitive drum cartridge disposed at a printing apparatus body, the toner cartridge assembly to develop toner on the photosensitive drum and collect used toner on the photosensitive drum, the toner cartridge assembly including a toner cartridge to correspond to the photosensitive drum cartridge at the body, having a developing roller to develop the toner on the photosensitive drum, a developing nip being formed between the developing roller and the photosensitive drum; and a used toner chamber movably connected to a side of the toner cartridge, the used toner chamber to store the used toner collected from the photosensitive drum cartridge, wherein the used toner chamber is fixed to the printing apparatus body, and the toner cartridge adjusts the developing nip by being connected with the used toner chamber such that the toner cartridge reciprocates and rotates in a direction of the photosensitive drum.

According to an aspect of the present invention, the toner cartridge reciprocates for a predetermined distance and rotates in relation to the used toner chamber.

According to another aspect of the present invention, the toner cartridge assembly further includes a first screw; a second screw; a first boss connected with the first screw to guide the reciprocation and the rotation of the toner cartridge; a second boss connected with the second screw to guide the reciprocation of the toner cartridge and to regulate a rotation angle of the toner cartridge, the first and second bosses being disposed at the side of the toner cartridge; a longitudinal hole formed in the used toner chamber to guide the reciprocation of the toner cartridge by being connected with the first screw; and a reaming hole formed in the used toner chamber to limit the rotation angle of the toner cartridge by limiting a range of movement of the second screw.

The toner cartridge assembly may further include a flange portion having a greater diameter than the longitudinal hole and the reaming hole, formed at each head portion of the first and second screws.

The toner cartridge assembly may further include a position deciding unit relatively coupled with a predetermined position of the body in order to fix a settlement position when being installed at the body.

According to yet another aspect of the present invention, the position deciding unit includes a pair of position deciding holes disposed at an upper part of the used toner chamber in order to be relatively connected with position deciding pins disposed at a predetermined area of the body.

The toner cartridge assembly may further include portions, disposed at an outer side of the toner cartridge, stepped in a direction in which the toner cartridge is installed at the body. The stepped portions guide the toner cartridge to the photosensitive drum cartridge when being installed at the body.

The foregoing and other objects of the present invention are also achieved by providing a printing apparatus including a body having first and second cartridge settlement units connected with each other; a photosensitive drum cartridge removably installed at the first cartridge settlement unit and having a photosensitive drum to be exposed to an outside thereof; a toner cartridge assembly removably installed at the second cartridge settlement unit, having a developing roller contacted with the photosensitive drum in order to form a predetermined developing nip and adjusted to a position thereof while being installed; and a press unit to maintain the developing nip by pushing the toner cartridge towards the photosensitive drum when the toner cartridge assembly is installed.

According to an aspect of the present invention, the printing apparatus further includes a used toner chamber inserted into the second cartridge settlement unit to collect and store used toner from the photosensitive drum cartridge; a toner cartridge, the developing roller being disposed therein and exposed to the outside, the toner cartridge to supply stored toner and to move in the second cartridge settlement unit; and a connecting unit to connect the toner cartridge with the used toner chamber such that the toner cartridge reciprocates and rotates with respect to the used toner chamber.

According to another aspect of the present invention, the printing apparatus further includes first and second screws connected at an end of the toner cartridge and being spaced a predetermined distance from each other; a longitudinal hole formed in the used toner chamber to guide the first screw during the reciprocation; and a reaming hole formed in the used toner chamber to guide the second screw during the reciprocation and to rotate for a predetermined angle around the first screw, wherein the first and the second screws respectively include a flange portion having a diameter greater than diameters of the longitudinal hole and the reaming hole, to prevent a separation of the toner cartridge and the used toner chamber.

The printing apparatus may further include a position fixing unit to fix the used toner chamber to the body when the toner cartridge assembly is installed at the second cartridge settlement unit.

Furthermore, the position fixing unit may include first and second position deciding pins protruding around the second cartridge settlement unit of the body; and first and second position deciding holes disposed at the used toner chamber to receive the position deciding pins.

Furthermore, the printing apparatus may further include first and second stepped portions formed at the outside of the toner cartridge assembly in a direction of installation, wherein the press unit includes first and second movable members disposed in the second cartridge settlement unit to correspond to the first and second stepped portions and to be pushed by being contacted with the first and second stepped portions of the toner cartridge assembly, and first and second pressing springs to push the developing roller to the photosensitive drum by elastically pressing the movable members towards the toner cartridge assembly.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
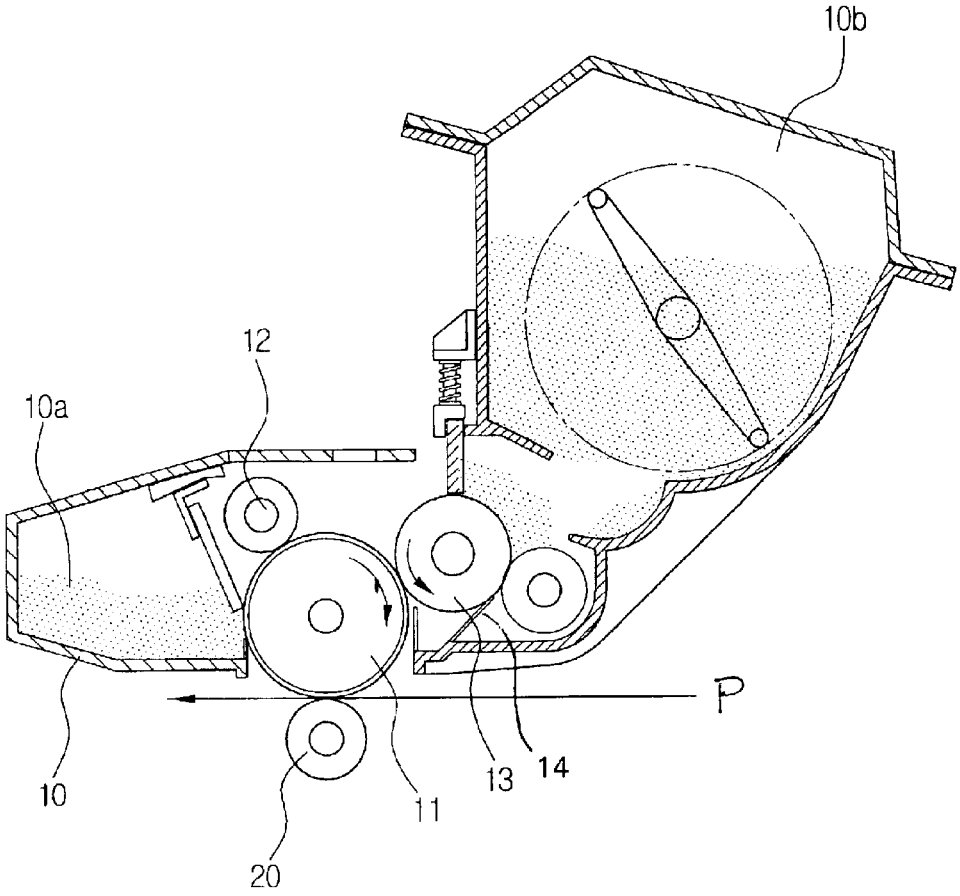
FIG. 1 (PRIOR ART)
FIG. 1 is a partial view schematically showing a conventional developing cartridge.

Reference will now be made in detail to the present preferred embodiments of the present invention, examples of which are illustrated in the accompanying drawings, wherein like reference numerals refer to like elements throughout.

Figure 2:
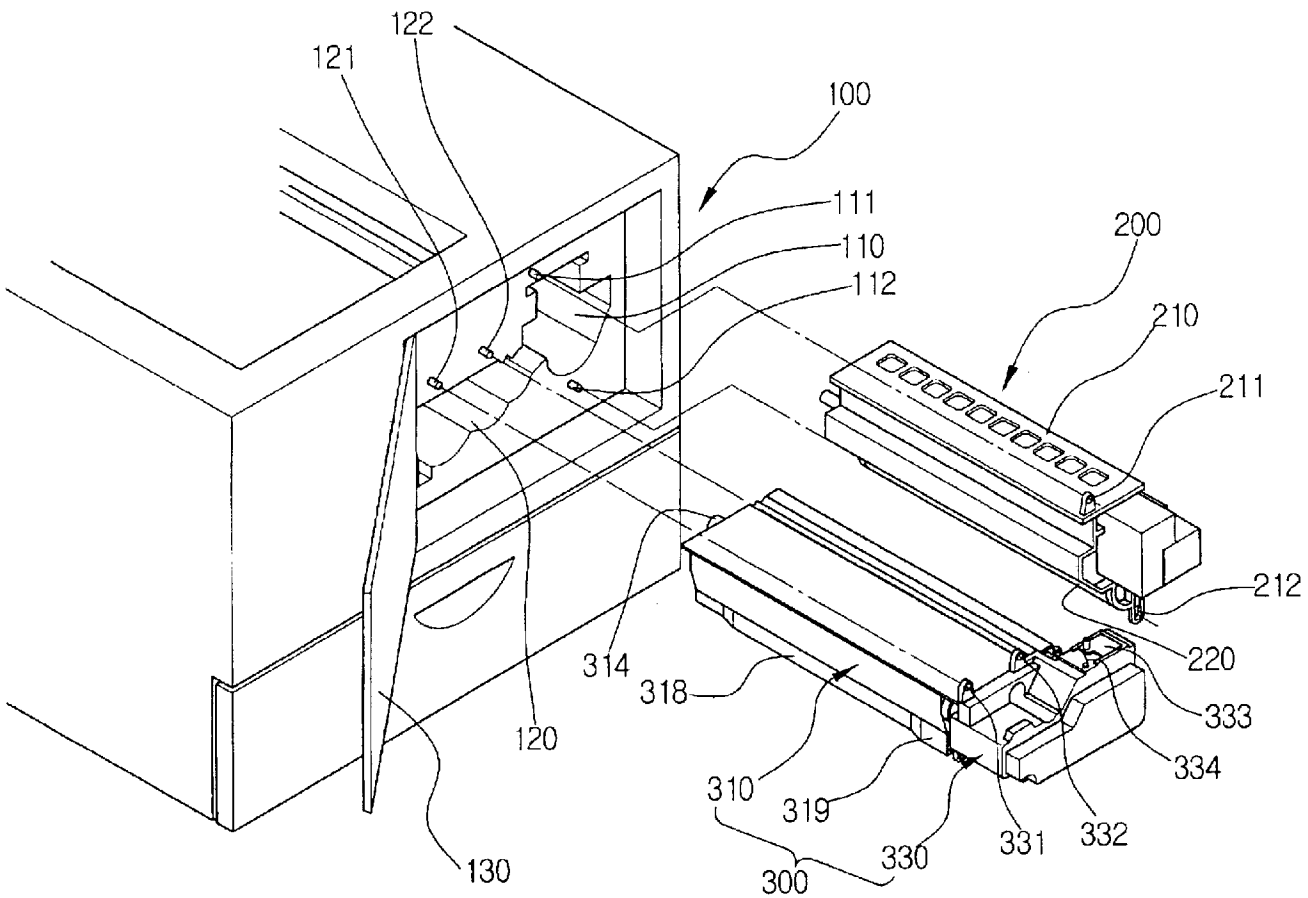
FIG. 2 is an exploded perspective view showing a printing apparatus according to an embodiment of the present invention.

Referring to FIG. 2, the printing apparatus according to the present invention includes a body 100, a photosensitive drum cartridge 200 removably disposed at the body 100, a toner cartridge assembly 300 and a pressing unit (described below).

The body 100 has a first cartridge settlement unit 110 in which the photosensitive drum cartridge 200 is removably disposed, and a second cartridge settlement unit 120 connected with the first cartridge settlement unit 110, in which the toner cartridge assembly 300 is disposed. Each of the settlement units 110 and 120 is closed and opened by a front door 130.

Figure 3:
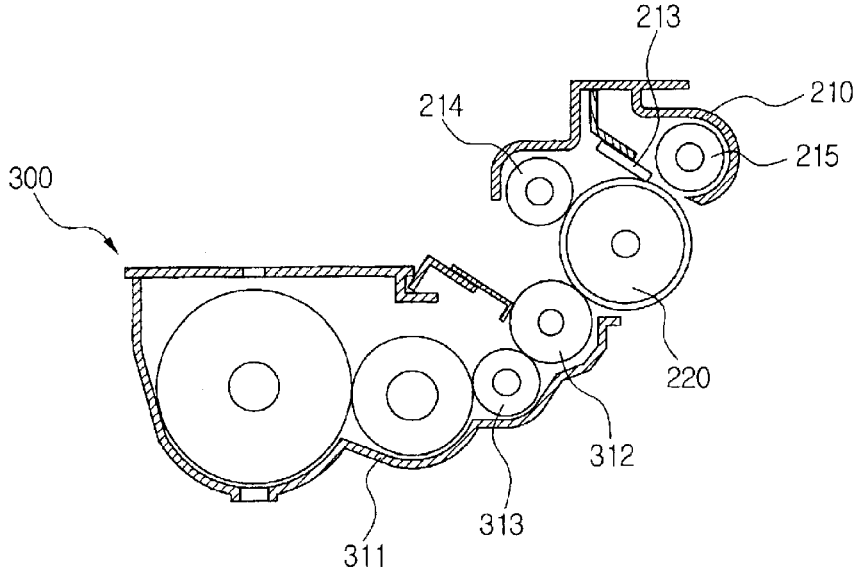
FIG. 3 is a view of the toner cartridge assembly and the photosensitive drum cartridge shown in FIG. 2.

The photosensitive drum cartridge 200 has a cartridge body 210, and a photosensitive drum 220 installed to be exposed to an outside of the body 210. Referring to FIG. 3, a charging roller 214, a cleaning blade 213, and a cleaning roller 215 are disposed inside of the cartridge body 210. Moreover, position decision holes 211 and 212 connected with position decision pins 111 and 112 disposed around the first cartridge settlement unit 110 are formed at a front end of the body 210.

Additionally, a toner discharging port (not shown) to discharge the used toner that is collected after being cleaned in the body 210 is formed to be able to be opened at a lower part of the front of the body 210.

The toner cartridge assembly 300 has a toner cartridge 310 inserted into the second cartridge settlement unit 120, a used toner chamber 330 movably connected with a front end of the toner cartridge 310, and a connection unit to connect the toner cartridge 310 with respect to the used toner chamber 330 to reciprocate for a predetermined distance and rotate.

The toner cartridge 310 includes a body 311 to store the toner and a developing roller 312 rotatably disposed at the body 311 (see FIG. 2). The developing roller 312 is exposed to an outside of the body 311, and is rotated by contacting the photosensitive drum 220 with a developing nip of the developing roller 312. The developing roller 312 receives the toner stored in the body 311 from a toner supply roller 313 and supplies the toner to the photosensitive drum 220. A coupler 314 to transfer power is disposed at a rear end of the body 311.

Moreover, first and second stepped portions 318 and 319 are formed at an outer side of the toner cartridge 310 in a settlement direction and are consecutively stepped.

The used toner chamber 330 is fixed in the second cartridge settlement unit 120, and a position fixing unit to fix the used toner chamber 330 to the body 100 is provided. The position fixing unit includes a pair of position deciding pins 121 and 122 disposed around the second cartridge settlement unit 120 of the body 100, and a pair of position deciding holes 331 and 332 to correspond to the position deciding pins 121 and 122 at an outside of the used toner chamber 330. In other words, as the position deciding pins 121 and 122 are connected to the position deciding holes 331 and 332, the used toner chamber 330 is fixed to the body 100.

On the other hand, a cover 333 to open and close the used toner chamber 330 to contain the used toner discharged from the photosensitive drum cartridge 200 is disposed to slide at an upper part of the used toner chamber 330. The cover 333 is opened to contact with an outside of the photosensitive drum cartridge 200 when the toner cartridge assembly 300 is installed at the second cartridge settlement unit 120, and is closed by a restoration force of a spring 334 when the toner cartridge assembly 300 is separated from the second cartridge settlement unit 120.

Figure 4:
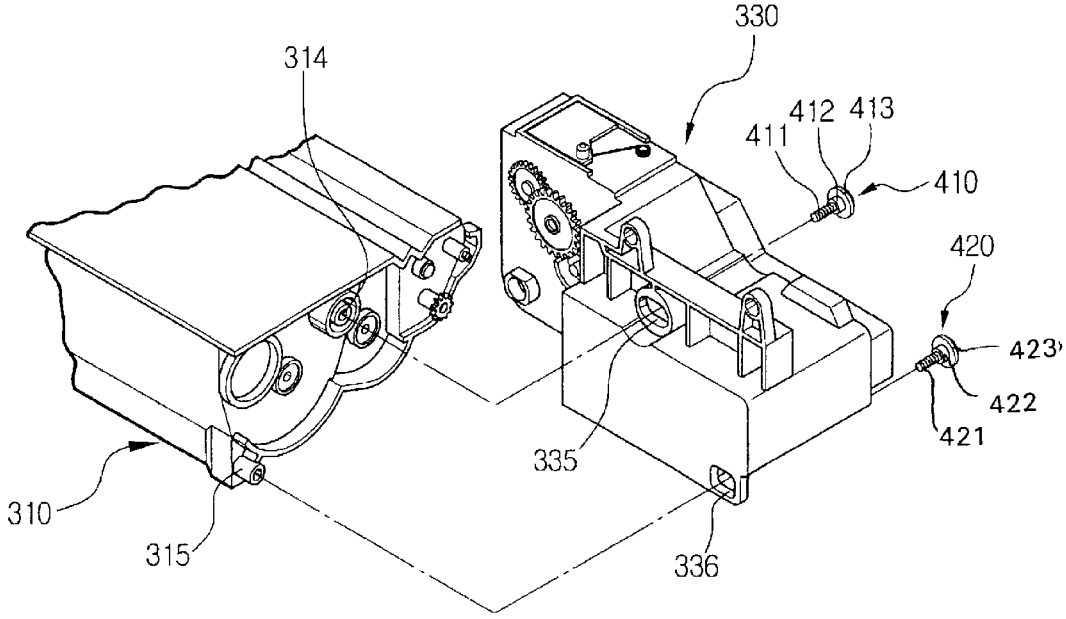
FIG. 4 is an exploded perspective view of the toner cartridge assembly shown in FIG. 2.

As shown in FIG. 4, the connection unit includes first and second screws 410 and 420 connected with first and second bosses 314 and 315, respectively, a longitudinal hole 335 formed at the used toner chamber 330 in order to movably receive the first screw 410, and a reaming hole 336 formed at the used toner chamber 330 in order to movably receive the second screw 420.

The first and second bosses 314 and 315 have a space in the up/down direction at the front end of the toner cartridge 310. The longitudinal hole 335 is formed to correspond to the first boss 314, and the reaming hole 336 is formed at a place corresponding to the second boss 315. The longitudinal hole 335 guides right and left movement of the toner cartridge 310, and the reaming hole 336 guides up and down movement of the toner cartridge 310.

The first screw 410 is connected with the first boss 314 after passing through the longitudinal hole 335. The first screw 410 has a connection portion 411 with a screw line, a support portion 412 having an outer diameter corresponding to a width of the longitudinal hole 335, and a flange portion 413 to prevent the used toner chamber 330 from being separated by having a greater outer diameter than the support portion 412. Consequently, the right and left movement of the toner cartridge 310 is guided as the first screw 410 is moved along the longitudinal hole 335 in the state in which the used toner chamber 330 is fixed to the body 100. Moreover, the second screw 420 has a connection portion 421, a support portion 422, and a flange portion 423.

Figure 5:
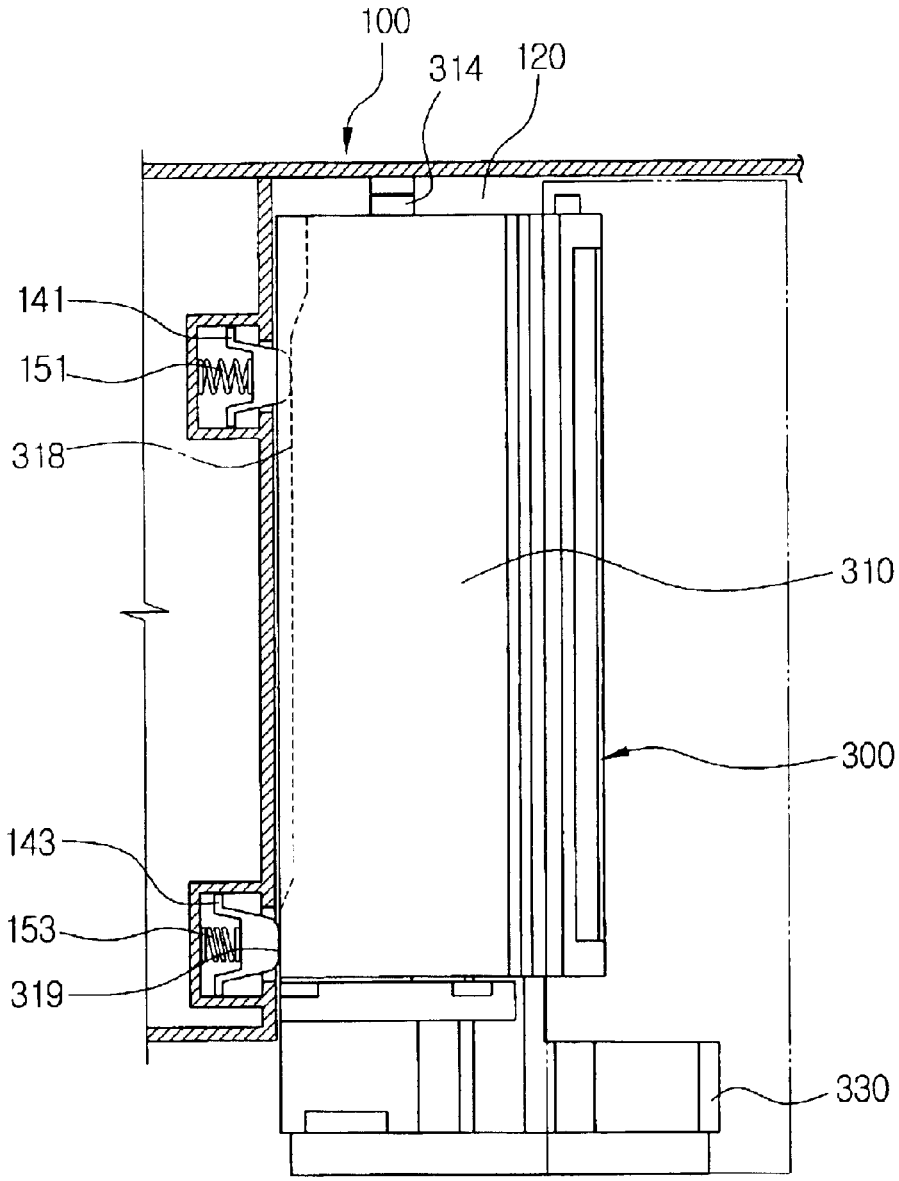
FIG. 5 is partial view schematically showing the settlement status of the toner cartridge assembly shown in FIG. 2.

The pressing unit maintains the developing nip in a constant state by pressing the toner cartridge 310 against the photosensitive drum 220 when the toner cartridge assembly 300 is settled at the second cartridge settlement unit 120. As shown in FIG. 5, the pressing unit has first and second movable members 141 and 143, movably disposed in the second cartridge settlement unit 120, and first and second pressing springs 151 and 153 to push the movable members 141 and 143 to the toner cartridge 310.

The first and second movable members 141 and 143 respectively press the stepped portions 318 and 319 of the toner cartridge 310 by being pushed by the pressing springs 151 and 153.

Hereinbelow, the operation of the printing apparatus according to the above described embodiment of the present invention having the above structure will be described.

First, the photosensitive drum cartridge 200 is settled at the first cartridge settlement unit 110 by being inserted in a lengthwise direction, as shown in FIG. 2. Specifically, the toner cartridge assembly 300 is inserted into the second cartridge settlement unit 120 in a lengthwise direction. When the toner cartridge assembly 300 is inserted into the second cartridge settlement unit 120, the stepped portions 318 and 319 of the toner cartridge assembly 300 are pushed to the photosensitive drum cartridge 200 by being contacted with the first and second movable members 141 and 143. In addition, the toner cartridge assembly 300 is completely inserted into the second cartridge settlement unit 120, and the used toner chamber 330 is fixed at the body 100.

In the meantime, as the toner cartridge 310 is removably connected with the used toner chamber 330, the toner cartridge 310 is moved horizontally and/or rotated by being pushed by the movable members 141 and 143.

In other words, the toner cartridge 310 is moved by being pushed (to the right, as shown in FIG. 5), centering the coupler 314 at the rear end. Moreover, the toner cartridge 310 is rotated for a predetermined angle based on the coupler 314 and the first screw 410. As described thus far, as the toner cartridge 310 is settled and moved by being pressed at the same time, the developing roller 312 is pushed to the photosensitive drum 220 in order to form a developing nip. Furthermore, the toner cartridge 310 is rotated and pressed, thus a rotation deviation caused by the run out of the developing roller 312 and the photosensitive drum 220 can be eliminated. In other words, the developing roller 312 maintains a constant developing nip and moves continuously when the printing operation takes place.

Figure 6A:
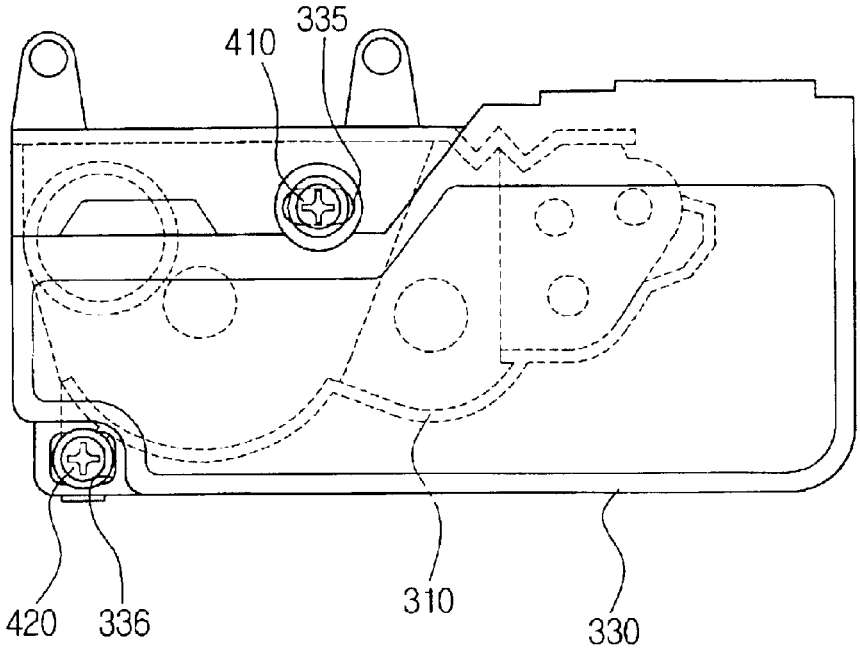
FIGS. 6A and 6B are front views showing the operation of the toner cartridge assembly shown in FIG. 2.

More specifically, as shown in FIG. 6A, the toner cartridge 310 and the used toner chamber 330 are inserted into the second cartridge settlement unit 120 when the toner cartridge 310 and the used toner chamber 330 are connected.

Figure 6B:
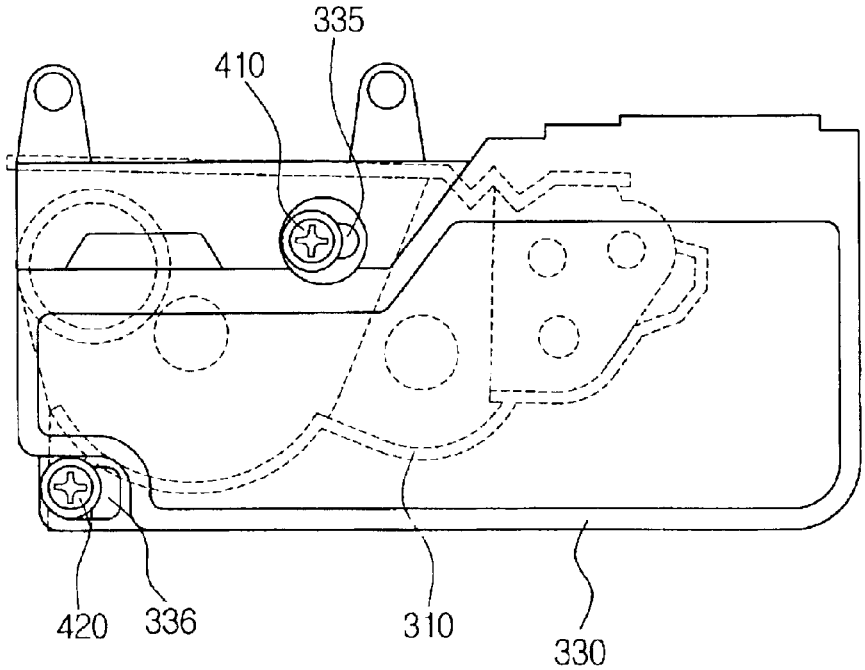

Additionally, after the toner cartridge 310 and the used toner chamber 330 are inserted into the second cartridge settlement unit 120, when the toner cartridge 310 moves by being pushed by the movable members 141 and 143, as shown in FIG. 6B, the position of the toner cartridge 310 is adjusted as the toner cartridge 310 is moved for a predetermined distance with respect to the used toner chamber 330 or is rotated.

According to the toner cartridge and the printing apparatus according to the described embodiment of the present invention, the toner cartridge having the developing roller can move relative to the used toner chamber when the toner cartridge is installed in the body. Therefore, the developing roller can maintain the developing nip between the photosensitive drum by moving slightly during a printing operation.

Furthermore, as the toner cartridge rotates, the run out of the developing roller and the photosensitive drum, and accumulated tolerance of each element can be eliminated.

Lastly, there is an advantage in that the abrasion caused by the physical contact of the photosensitive drum and the developing roller can be reduced, and the distortion of the image can be prevented by maintaining the developing nip in a constant state.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A toner cartridge assembly installed next to a photosensitive drum in a printing apparatus, the toner cartridge assembly comprising:

a toner cartridge having a developing roller to develop toner on the photosensitive drum, a developing nip being formed between the developing roller and the photosensitive drum; and a used toner chamber connected to the toner cartridge to store used toner collected from the photosensitive drum, wherein the developing roller moves continuously with a run out of the developing roller and the photosensitive drum to maintain the developing nip.

2. A toner cartridge assembly installed next to a photosensitive drum cartridge including a photosensitive drum and disposed in a body of a printing apparatus, the toner cartridge assembly to develop toner on the photosensitive drum and collect used toner from the photosensitive drum, the toner cartridge assembly comprising:

a toner cartridge having a developing roller to develop the toner on the photosensitive drum, a developing nip being formed between the developing roller and the photosensitive drum; and a used toner chamber movably connected to a side of the toner cartridge, the used toner chamber to store the used toner collected from the photosensitive drum, wherein the used toner chamber is fixed to the body of the printing apparatus, and the toner cartridge adjusts the developing nip by being connected with the used toner chamber such that the toner cartridge reciprocates and rotates relative to the used toner chamber.

3. The toner cartridge assembly of claim 2, further comprising:

a first screw;

a second screw;

a first boss connected to the first screw to guide the reciprocation and the rotation of the toner cartridge;

a second boss connected with the second screw to guide the reciprocation of the toner cartridge and to regulate a rotation angle of the toner cartridge, the first and second bosses being disposed at the side of the toner cartridge;

a longitudinal hole formed in the used toner chamber to guide the reciprocation of the toner cartridge by being connected with the first screw; and a reaming hole formed in the used toner chamber to limit the rotation angle of the toner cartridge by limiting a range of movement of the second screw.

4. The toner cartridge assembly of claim 3, wherein the first and second screws each comprise:

a head portion; and a flange portion having a diameter greater than diameters of the longitudinal hole and the reaming hole, the flange portions being formed at the head portions of the first and second screws.

5. The toner cartridge assembly of claim 2, wherein the used toner chamber comprises a position deciding unit to couple with the body of the printing apparatus.

6. The toner cartridge assembly of claim 5, wherein the body of the printing apparatus further comprises first and second deciding pins, and the position deciding unit comprises:

first and second position deciding holes disposed at an upper part of the used toner chamber, to respectively connect with the first and second position deciding pins.

7. The toner cartridge assembly of claim 2, further comprising:

first and second stepped portions disposed at an outer side of the toner cartridge, the stepped portions to guide the toner cartridge towards the photosensitive drum cartridge.

8. A printing apparatus, comprising:

a body having first and second cartridge settlement units connected with each other;

a photosensitive drum cartridge removably installed at the first cartridge settlement unit and having a photosensitive drum to be exposed to an outside thereof;

a toner cartridge assembly removably installed at the second cartridge settlement unit, comprising a developing roller in contact with the photosensitive drum in order to form a predetermined developing nip and to adjust a position of the developing nip; and a press unit to maintain the developing nip by pushing the toner cartridge towards the photosensitive drum.

9. The printing apparatus of claim 8, wherein the toner cartridge assembly further comprises:

a used toner chamber inserted into the second cartridge settlement unit to collect and store used toner from the photosensitive drum cartridge;

a toner cartridge, the developing roller being disposed therein and exposed to the outside, the toner cartridge to supply stored toner to the photosensitive drum and to move within the second cartridge settlement unit; and a connecting unit to connect the toner cartridge with the used toner chamber such that the toner cartridge reciprocates and rotates with respect to the used toner chamber.

10. The printing apparatus of claim 9, wherein the connecting unit comprises:

first and second screws connected at an end of the toner cartridge and being spaced a predetermined distance from each other;

a longitudinal hole formed in the used toner chamber to guide the first screw during the reciprocation; and a reaming hole formed in the used toner chamber to guide the second screw during the reciprocation and to rotate for a predetermined angle around the first screw, wherein the first and second screws respectively comprise a flange portion having a diameter greater than diameters of the longitudinal hole and the reaming hole, to prevent a separation of the toner cartridge and the used toner chamber.

11. The printing apparatus of claim 9, further comprising a position fixing unit to fix the used toner chamber to the body.

12. The printing apparatus of claim 11, wherein the position fixing unit comprises:

first and second position deciding pins protruding around the second cartridge settlement unit of the body; and first and second position deciding holes disposed at the used toner chamber to receive the position deciding pins.

13. The printing apparatus of claim 8, further comprising:

first and second stepped portions formed at the outside of the toner cartridge assembly, wherein the press unit comprises:

first and second movable members disposed in the second cartridge settlement unit to correspond to the first and second stepped portions and to be pushed by being in contact with the first and second stepped portions of the toner cartridge assembly, and first and second pressing springs to push the developing roller to the photosensitive drum by elastically pressing the movable members toward the toner cartridge assembly.

14. A toner cartridge assembly installed next to a photosensitive drum in a printing apparatus, the toner cartridge assembly comprising:

a toner cartridge having a developing roller to develop toner on the photosensitive drum, a developing nip being formed between the developing roller and the photosensitive drum; and a used toner chamber connected the toner cartridge to store used toner collected from the photosensitive drum, wherein the toner cartridge maintains the developing nip by moving relative to the used toner chamber.

15. The toner cartridge assembly of claim 14, wherein the toner cartridge is rotated and moved linearly relative to the toner chamber.

16. A printing apparatus comprising:

a photosensitive drum;

a toner cartridge assembly next to the photosensitive drum, comprising:

a toner cartridge having a developing roller to develop toner on the photosensitive drum, a developing nip being formed between the developing roller and the photosensitive drum, and a used toner chamber connected the toner cartridge to store used toner collected from the photosensitive drum, wherein the toner cartridge maintains the developing nip by reciprocating and rotating relative to the used toner chamber.

17. The printing apparatus of claim 16, further comprising:

a press unit to move the toner cartridge towards the photosensitive drum and thereby cause the movement relative to the used toner chamber.

18. The printing apparatus of claim 17, further comprising:

first and second stepped portions formed on an outside of the toner cartridge assembly, wherein the press unit comprises:

first and second movable members corresponding to the first and second stepped portions and pushed by being in contact with the first and second stepped portions, and first and second springs to push the developing roller towards the photosensitive drum by pressing the movable members towards the toner cartridge assembly.

19. The printing apparatus of claim 18, wherein the press unit moves the toner cartridge towards the photosensitive drum in accordance with a run out of the developing roller and the photosensitive drum.

20. A printing apparatus comprising:

a photosensitive drum;

a toner cartridge assembly next to the photosensitive drum, comprising a developing roller to develop toner on the photosensitive drum, a developing nip being formed between the developing roller and the photosensitive drum; and a press unit to move the toner cartridge assembly towards the photosensitive drum to thereby maintain the developing nip during a run out of the developing roller and the photosensitive drum.

* * * * *